US007080839B2

(12) United States Patent
Shackleford

(10) Patent No.: US 7,080,839 B2
(45) Date of Patent: Jul. 25, 2006

(54) BLACKJACK VARIATIONS

(76) Inventor: Michael Shackleford, 9200 Sienna Vista Dr., Las Vegas, NV (US) 89117

( * ) Notice: Subject to any disclaimer, the term of this patent is extended or adjusted under 35 U.S.C. 154(b) by 0 days.

(21) Appl. No.: 10/877,266

(22) Filed: Jun. 29, 2004

(65) Prior Publication Data

US 2005/0285343 A1 Dec. 29, 2005

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,639,092 A * 6/1997 Macaisa ..... 273/292
5,645,281 A * 7/1997 Hesse et al. ..... 273/292
5,803,460 A * 9/1998 Hesse ..... 273/292
5,823,536 A * 10/1998 Flasch ..... 273/292
5,979,897 A * 11/1999 Grossman ..... 273/292
5,984,308 A * 11/1999 Herrmann ..... 273/292
6,000,699 A * 12/1999 Long ..... 273/292
6,012,719 A 1/2000 Webb
6,296,251 B1 * 10/2001 Webb ..... 273/292
6,371,867 B1 4/2002 Webb
6,394,456 B1 * 5/2002 Long ..... 273/292
6,422,565 B1 * 7/2002 Daines ..... 273/292
6,474,649 B1 * 11/2002 Kennedy et al. ..... 273/304
6,481,719 B1 11/2002 Webb
6,523,831 B1 2/2003 Webb
6,540,230 B1 * 4/2003 Walker et al. ..... 273/292
6,598,879 B1 * 7/2003 Spur et al. ..... 273/292
6,679,497 B1 * 1/2004 Walker et al. ..... 273/292
6,866,267 B1 * 3/2005 Hesse ..... 273/292
6,869,077 B1 * 3/2005 Ozmulla et al. ..... 273/292
2001/0035610 A1 11/2001 Webb
2002/0000693 A1 1/2002 Webb
2004/0080110 A1 4/2004 Webb

OTHER PUBLICATIONS

Shackleford, "Blackjack Appendix 8", http://wizardofodds.com/games/blackjack/bjapx8.html, published Jun. 26, 2004 as attached, article has appeared in various forms >1 year.

* cited by examiner

*Primary Examiner*—Eugene Kim
*Assistant Examiner*—Dolores R. Collins
(74) *Attorney, Agent, or Firm*—Muskin & Cusick LLC

(57) ABSTRACT

A method and computer readable storage medium to play an improved variation of blackjack. The method includes (a) receiving an original wager for the blackjack game; (b) dealing a player's hand and a dealer's hand; (c) finishing the game; and (d) if the player's hand ties the dealer's hand then the player wins a payout from the original wager.

4 Claims, 1 Drawing Sheet

BLACKJACK VARIATIONS

BACKGROUND OF THE INVENTION

1. Field of the Invention

The present invention is directed to a method and computer readable storage for blackjack variations. More particularly, the present invention provides a player with a reward when the player's hand ties the dealer's hand.

2. Description of the Related Art

Blackjack is a popular form of gambling in Internet and brick and mortar casinos. New variations of blackjack are needed in order to provide new and exciting opportunities to attract players.

What is needed is a new and exciting variation that players may prefer over the standard game of blackjack.

SUMMARY OF THE INVENTION

It is an aspect of the present invention to provide improvements and innovations in blackjack games.

The above aspects can be obtained by a system that includes (a) receiving an original wager for the blackjack game; (b) dealing a player's hand and a dealer's hand; (c) finishing the game; (d) if the player's hand ties the dealer's hand then the player wins a payout from the original wager.

The above aspects can also be obtained by a system that includes (a) receiving an original wager; (b) receiving a side wager; (c) dealing a player's two cards and a dealer's upcard; (d) if the player's two cards and the dealer's upcard comprise three of a kind, then paying the side wager according to a respective payout; and (e) if both player's two cards and the dealer's upcard incorporate a two of a kind, then paying the side wager according to a respective payout.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
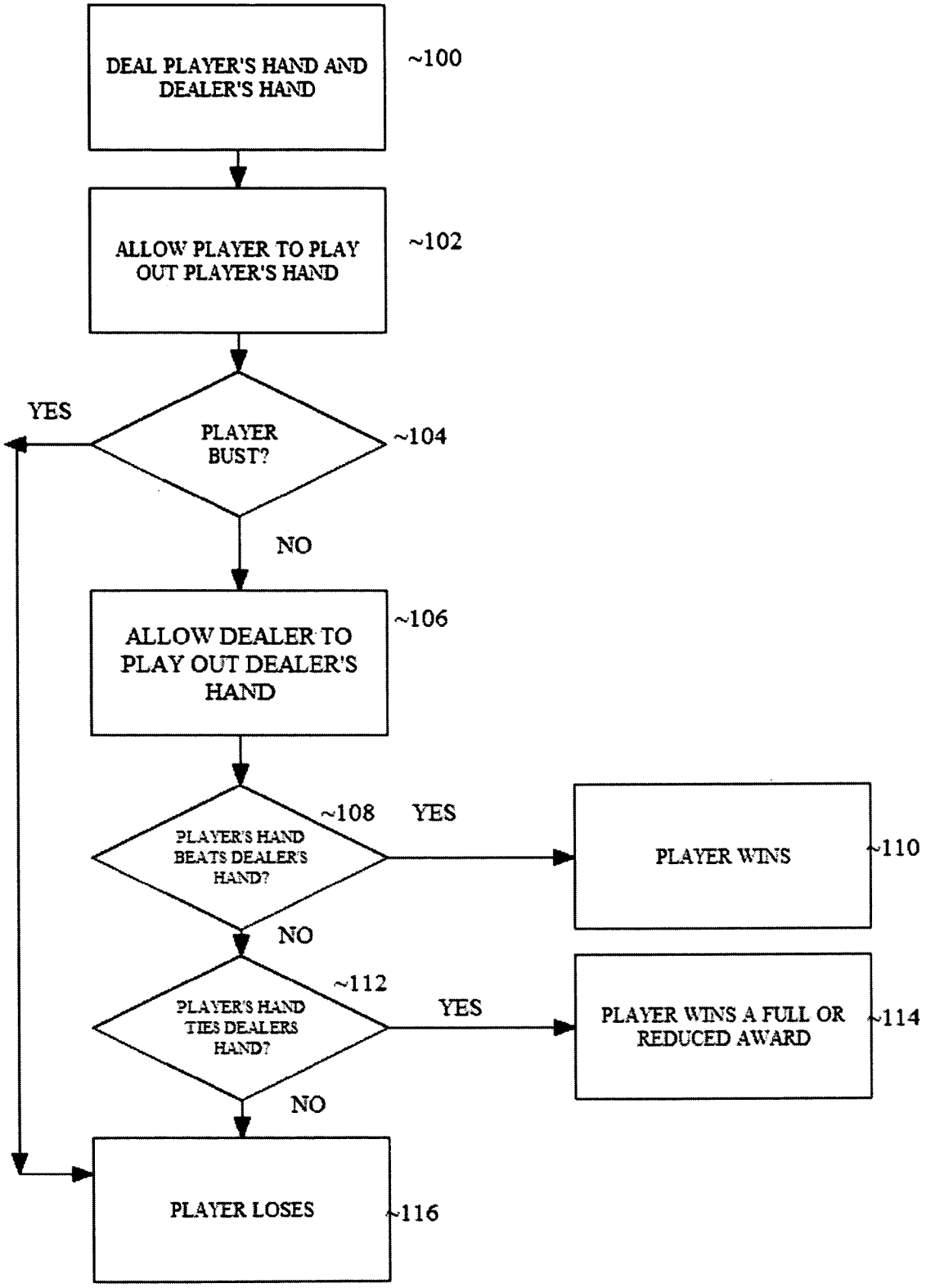
FIG. 1 illustrates an exemplary flowchart illustrating method to implement an improved blackjack variation, according to an embodiment.

Reference will now be made in detail to the presently preferred embodiments of the invention, examples of which are illustrated in the accompanying drawings, wherein like reference numerals refer to like elements throughout.

The present invention relates to blackjack games and variations thereof.

The present invention provides for a In an embodiment, a blackjack game is played in which the player wins on a tie. Of course, the game must provide some type of disadvantage to the player in order for game to still have a mathematical advantage over the player. For example, a player can be prohibited from doubling and/or splitting, in some or all circumstances.

Table I illustrates a preferred set of rules for the game.

TABLE I

| |
|---|
| 1. The game follows conventional blackjack rules except as noted. |
| 2. The game may be played with any number of standard 52-card decks, although at least four is recommended. |
| 3. The dealer may either hit or stand on soft 17, although hitting is recommended. |
| 4. All ties shall pay 1 to 2. |
| 5. The player may not double nor split. |
| 6. Winning blackjacks pay 1 to 1. |

It is noted that other variations of these game rules can be implemented as well. For example, blackjacks may pay 3:2, 6:5, or other multiple of the player's bet. A player may be allowed to double and/or split. The player may be allowed to double only upon certain circumstances, or split only upon certain circumstances. Ties may pay another return other than 1:2 (e.g. 1:3 or any other payout). Ties may also be paid on a commission basis that is upon a tie, the house pays a certain percentage (e.g. 45%) of the player's wager. Alternatively, the house may take a set commission on all wins (e.g. 95%). Alternatively, other types of decks can be used, e.g. Spanish decks.

The general principal regarding an embodiment is to provide a game wherein a player can receive a monetary award on a tie from the player's basic bet alone, thereby causing excitement by the player since player's realize how often ties occur. This general principal can be accomplished in numerous ways, such as variations and combinations of the above rules.

It is noted that any of the above variations can be combined or modified with each other. Typically, the rules should be combined such that optimal strategy by the player should result in the house having a mathematical advantage.

FIG. 1 illustrates an exemplary flowchart illustrating method to implement an improved blackjack variation, according to an embodiment.

The method starts in operation 100, which deals the player's hand and the dealer's hand.

The method then proceeds to operation 102, which allows the player to play out the player's hand.

The method then proceeds to operation 104, which checks if the player busts (receives a hard point total over 21). If the check in operation 104 determines that the player has busted, then the method proceeds to operation 116, wherein the player loses and the player's original wager is collected. Once the player's original wager has been taken, a new game can begin by starting the method over again at operation 100.

If the check in operation 104 determines that the player has not busted, then the method proceeds to operation 106, which allows the dealer to play out the dealer's hand. This typically encompasses the player hitting or standing based on predefined house rules.

From operation 106, the method proceeds to operation 108, which checks if the player's hand beat the dealer's hand. If so, the method proceeds to operation 110, wherein the player wins and is paid on his original wager. The player is typically paid even money, although other variations can be implemented where the player receives an alternative amount (e.g. a percentage of his or her original bet). Certain hands may also pay more or less than others, (e.g. a blackjack can pay more such as 3:2). Once the player has won, a new game can begin by starting the method over again at operation 100.

If the check in operation 108 results that the player did not beat the dealer's hand, then the method can proceed to operation 112, which checks if the player ties the dealer's hand. If the player ties the dealer's hand, then the method proceeds to operation 114, wherein the player receives an award. The award can be one half (or any multiple) of the player's original bet. Alternatively, on some predetermined hands, the award can be higher or lower than others (e.g. a blackjack may pay higher than other ties). Once the player has won, a new game can begin by starting the method over again at operation 100.

If the check in operation 112 determines that the player does not tie the dealer's hand, then this means that the player's hand is lower than the dealer's hand. Thus, the method proceeds to operation 116, in which the player loses and the house takes the player's wager. Once the wager has been taken, a new game can begin by starting the method over again at operation 100.

It is noted that the above described method can be performed in any feasible order. Further, the method can include other modifications that are currently known in the blackjack arts.

Table II illustrates the optimal basic player strategy when the dealer hits a soft 17. This strategy should work with any number of decks, e.g. 8. The player's hand is along the left column and the dealer's up card along the top row.

TABLE II

| Player | 2 | 3 | 4 | 5 | 6 | 7 | 8 | 9 | 10 | Ace |
|---|---|---|---|---|---|---|---|---|---|---|
| 4 | H | H | H | H | H | H | H | H | H | H |
| 5 | H | H | H | H | H | H | H | H | H | H |
| 6 | H | H | H | H | H | H | H | H | H | H |
| 7 | H | H | H | H | H | H | H | H | H | H |
| 8 | H | H | H | H | H | H | H | H | H | H |
| 9 | H | H | H | H | H | H | H | H | H | H |
| 10 | H | H | H | H | H | H | H | H | H | H |
| 11 | H | H | H | H | H | H | H | H | H | H |
| 12 | H | H | H | S | S | H | H | H | H | H |
| 13 | H | S | S | S | S | H | H | H | H | H |
| 14 | S | S | S | S | S | H | H | H | H | H |
| 15 | S | S | S | S | S | H | H | H | H | H |
| 16 | S | S | S | S | S | H | H | H | H | H |
| 17 | S | S | S | S | S | S | S | S | S | S |
| 18 | S | S | S | S | S | S | S | S | S | S |
| 19 | S | S | S | S | S | S | S | S | S | S |
| 20 | S | S | S | S | S | S | S | S | S | S |
| 21 | S | S | S | S | S | S | S | S | S | S |
| A, A | H | H | H | H | H | H | H | H | H | H |
| A, 2 | H | H | H | H | H | H | H | H | H | H |
| A, 3 | H | H | H | H | H | H | H | H | H | H |
| A, 4 | H | H | H | H | H | H | H | H | H | H |
| A, 5 | H | H | H | H | H | H | H | H | H | H |
| A, 6 | H | H | H | H | H | H | H | H | H | H |
| A, 7 | S | S | S | S | S | S | S | H | H | H |
| A, 8 | S | S | S | S | S | S | S | S | S | S |
| A, 9 | S | S | S | S | S | S | S | S | S | S |
| A, 10 | S | S | S | S | S | S | S | S | S | S |

When the dealer stands on soft 17 is that the player should hit 12 against a dealer 6.

Table III shows the house edge, assuming optimal player strategy, according to the number of decks and whether the dealer hits or stands on soft 17.

TABLE III

| Decks | Dealer hits on soft 17 | Dealer stands on soft 17 |
|---|---|---|
| 1 | 0.247% | 0.003% |
| 2 | 0.400% | 0.150% |
| 3 | 0.445% | 0.193% |
| 4 | 0.467% | 0.214% |
| 5 | 0.480% | 0.226% |
| 6 | 0.489% | 0.233% |
| 7 | 0.495% | 0.238% |
| 8 | 0.500% | 0.242% |

The preferred embodiment is the rule set from Table I, with eight decks, wherein the dealer hits on soft 17. The latter two parameters provide the greatest house edge.

Thus, an embodiment of the game provides a player an ability to win on ties. This can be advantageous for numerous reasons. In the prior art game where ties push (no money is exchanged), time is wasted since no money is actually transferred. Players may also psychologically be attracted to this game by thinking that they are getting something extra by winning on ties. Further, some beginning players may prefer this game since the strategy is simpler since splitting and/or doubling may not be allowed.

In a further embodiment, a side bet can be offered to the player. A side bet is an optional additional wager ancillary to the original main wager, in which it does not necessarily follow that both wagers always win or lose together. A side bet can provide players additional entertainment value by providing them more ways to win. A player will place a side wager alongside the player's original wager. After the player's hand and the dealer's hand are dealt, the dealer can then immediately account for the side bets or wait until the blackjack hand is finished before paying the side bets.

Table IV below illustrates an example of a side bet, according to an embodiment. In the example in Table IV, both the player's two cards and the dealer's upcard are used. If all three cards comprise three of a kind in the same suit, then this can pay 300 (although of course the payout can vary). If all three cards comprise an unsuited three of a kind, then this can pay 30 (although of course the payout can vary). An unsuited three of a kind are three cards with the same face value but not all the same suit, e.g. all different suits or two different suits (e.g. one spade and two hearts). If a suited pair exists within the three cards, then this can pay 5 (although of course the payout can vary). If a nonsuited pair exists within the three cards, then this can pay 2 (although of course the payout can vary). In this example, other combinations typically lose and the player loses his or her original wager.

TABLE IV

| | Version 1, 6 standard decks | | | |
|---|---|---|---|---|
| Win | Permutations | Probability | Pays | Return |
| Suited three of a kind | 6240 | 0.000207 | 300 | 0.062234 |
| Unsuited three of a kind | 151632 | 0.005041 | 30 | 0.151229 |
| Any suited pair | 1347840 | 0.044809 | 5 | 0.224043 |
| Any unsuited pair | 4852224 | 0.161311 | 2 | 0.322622 |
| Other | 23721984 | 0.788632 | −1 | −0.78863 |
| Total | 30079920 | 1 | | −0.0285 |

Table V below illustrates another example of a side bet, according to an embodiment. This operates similar to the example in Table IV, although the winning combination of "any suited pair" and "any unsuited pair" in Table IV is now replaced with "player suited pair" and "player any pair." Thus, in this example, the player suited pair is won when the player's two cards form a suited pair, while the dealer's card does not matter. The player any pair is won when the player's two cards form a non-suited pair, while the dealer's card does not matter.

TABLE V

Version 2, 6 standard decks

| Win | Permutations | Probability | Pays | Return |
|---|---|---|---|---|
| Suited three of a kind | 6240 | 0.000207 | 200 | 0.041489 |
| Unsuited three of a kind | 151632 | 0.005041 | 40 | 0.201639 |
| Player suited pair | 449280 | 0.014936 | 15 | 0.224043 |
| Player any pair | 1617408 | 0.05377 | 8 | 0.430163 |
| Other | 27855360 | 0.926045 | −1 | −0.92605 |
| Total | 30079920 | 1 | | −0.02871 |

Table VI below illustrates yet another example of a side bet, according to an embodiment. In this example, if the player's two cards and the dealer's upcard are identical (same suit and face value), then this combination wins 500 (although of course other payouts can be used). If the three cards all have the same face value and are also of the same color, then this is considered a "colored three of a kind." If the three cards all have the same face value, but are all not of the same color, then this can be considered a "mixed colors three of a kind." If the three cards are of the same suit (but the face value does not matter), then this can be considered "three suited cards." If the three cards are of the same color (but the face value does not matter), then this can be considered "three colored cards."

TABLE VI

Version 3, 6 standard decks

| Win | Permutations | Probability | Pays | Return |
|---|---|---|---|---|
| Suited three of a kind | 6240 | 0.000207 | 500 | 0.103724 |
| Colored three of a kind | 28080 | 0.000934 | 100 | 0.093351 |
| Mixed colors three of a kind | 123552 | 0.004107 | 25 | 0.102686 |
| Three suited cards | 1819584 | 0.060492 | 10 | 0.604917 |
| Other | 28102464 | 0.93426 | −1 | −0.93426 |
| Total | 30079920 | 1 | | −0.02958 |

In further embodiments, Spanish decks can be used for a side bet. A Spanish deck is a 48 card deck with the tens removed. Tables VII, VIII, IX represent the side bets illustrated in Tables IV, V, and VI, respectively, but for use with Spanish decks. Since Spanish decks have a different composition then standard decks, the probabilities are different and hence the payouts are adjust to reflect this.

TABLE VII

Version 4, 6 Spanish decks

| Win | Permutations | Probability | Pays | Return |
|---|---|---|---|---|
| Suited three of a kind | 5760 | 0.000244 | 150 | 0.036549 |
| Unsuited three of a kind | 139968 | 0.005921 | 20 | 0.118418 |
| Any suited pair | 1140480 | 0.048244 | 5 | 0.241222 |
| Any unsuited pair | 4105728 | 0.17368 | 2 | 0.34736 |
| Other | 18247680 | 0.771911 | −1 | −0.77191 |
| Total | 23639616 | 1 | | −0.02836 |

TABLE VIII

Version 5, 6 Spanish decks

| Win | Permutations | Probability | Pays | Return |
|---|---|---|---|---|
| Suited three of a kind | 5760 | 0.000244 | 250 | 0.060915 |
| Unsuited three of a kind | 139968 | 0.005921 | 40 | 0.236836 |
| Player suited pair | 380160 | 0.016081 | 15 | 0.241222 |
| Player any pair | 1368576 | 0.057893 | 6 | 0.34736 |
| Other | 21745152 | 0.919861 | −1 | −0.91986 |
| Total | 23639616 | 1 | | −0.03353 |

TABLE IX

Version 6, 6 Spanish decks

| Win | Permutations | Probability | Pays | Return |
|---|---|---|---|---|
| Suited three of a kind | 5760 | 0.000244 | 500 | 0.121829 |
| Colored three of a kind | 25920 | 0.001096 | 100 | 0.109646 |
| Mixed colors three of a kind | 114048 | 0.004824 | 40 | 0.192978 |
| Three suited cards | 1425600 | 0.060306 | 8 | 0.482444 |
| Other | 22068288 | 0.93353 | −1 | −0.93353 |
| Total | 23639616 | 1 | | −0.02663 |

Further embodiments can include other combinations of the winning conditions illustrated in Tables IV–IX, and can also include other known winning combinations. For example, according to an embodiment, a side bet may include mixed colors three of a kind and player any pair as winning combinations. The concepts described herein can be mixed and matched with other side bet concepts.

Further, the side bets described herein can also be used with the ties win blackjack game also described herein. The side bets described herein can also be used with any other blackjack variations as well. The side bets described in Tables XII–IX are recommended for use with the blackjack variant known as "Spanish 21," which uses Spanish decks.

In yet a further embodiment, when the player makes a side bet (such as any of the ones described herein), the player is required to make a side bet that is at least a predetermined percentage of the player's primary bet. This may offset any advantage the player may have in the main blackjack portion of the game. Thus, for example, a blackjack game can be offered with a player advantage (if the player uses optimal strategy). However, if the player is required to also play a side bet for at least a certain percentage of the original wager which carries a house advantage, then this would offset the player advantage and generate a profit for the house in the long run. Thus, a ties win game can be offered which has a player advantage (e.g. ties pay even money), but the forced side bet recoups any expected loss for the house. For example, assuming a basic blackjack game lets the player win on all ties, the player advantage may be 10%. A forced side bet requiring 50% of the player's original bet would need to have a house advantage of greater than 20% in order to make the game have a house edge. Any known or conceived side bet can be used for this method.

All of the embodiments herein can also be implemented on a digital computer. Programs and/or data needed to implement the methods described herein can be stored on a digital storage medium. Further, the methods described herein can also be implemented on an online or Internet casino, allowing a player to play these methods from a remote client for real or play money.

It is also noted that any and/or all of the above embodiments, configurations, variations of the present invention described above can mixed and matched and used in any combination with one another. Any claim herein can be combined with any others (unless the results are nonsensical). Further, any mathematical formula given above also includes its mathematical equivalents, and also variations thereof such as multiplying any of the individual terms of a formula by a constant(s) or other variable.

Moreover, any description of a component or embodiment herein also includes hardware, software, and configurations which already exist in the prior art and may be necessary to the operation of such component(s) or embodiment(s).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of playing a blackjack game, the method comprising:

receiving an original wager for the blackjack game;

dealing a player's hand and a dealer's hand;

finishing the game; and if the player's hand ties the dealer's hand then the player wins a payout from the original wager, wherein the player wins 1:2 of the original wager on a tie, wherein the player is never allowed to double down ever in the game, wherein the player is never allowed to split ever in the game.

2. A method as recited in claim 1, wherein if the player's hand and the dealer's hand are both blackjack, the player wins 1:2 of the original wager.

3. A method as recited in claim 1, wherein if the player's hand is a blackjack and the dealer's hand is not a blackjack, the player wins even money from the original wager.

4. A method of playing a blackjack game, the method comprising:

receiving an original wager for the blackjack game;

dealing a player's hand and a dealer's hand;

finishing the game; and if the player's hand ties the dealer's hand then the player wins a payout from the original wager, wherein the player is not allowed to double down on all initial two card combinations, wherein the player is not allowed to split on all initial two card combinations.

* * * * *